US007523894B1

(12) United States Patent
Eddy

(10) Patent No.: US 7,523,894 B1
(45) Date of Patent: Apr. 28, 2009

(54) EAVES TROUGH SUPPORT BRACKET

(76) Inventor: Gary R Eddy, 7259 Laverne Ave. South, Cottage Grove, MN (US) 55016

( * ) Notice: Subject to any disclaimer, the term of this patent is extended or adjusted under 35 U.S.C. 154(b) by 1479 days.

(21) Appl. No.: 10/033,580

(22) Filed: Dec. 28, 2001

(51) Int. Cl.
*E04D 13/06* (2006.01)

(52) U.S. Cl. ..... 248/48.2; 248/216.1; 52/16

(58) Field of Classification Search ..... 248/48.1, 248/48.2, 242, 250, 235
See application file for complete search history.

(56) References Cited

U.S. PATENT DOCUMENTS

| | | | | | |
|---|---|---|---|---|---|
| 1,855,241 | A | * | 4/1932 | Irwin | |
| 3,041,033 | A | * | 6/1962 | Schwartz | 248/248 |
| 3,053,491 | A | * | 9/1962 | Ramser | 248/48.2 |
| 3,416,760 | A | | 12/1968 | Sauder | 248/48.2 |
| 3,426,987 | A | | 2/1969 | Leslie | 248/48.2 |
| 3,737,127 | A | | 6/1973 | Maloney, Jr. et al. | 248/48.2 |
| 4,210,301 | A | | 7/1980 | Weiss | 248/48.2 |
| 4,241,548 | A | * | 12/1980 | Rowe | 52/11 |
| 4,294,422 | A | * | 10/1981 | Odekirk | 248/48.2 |
| 5,004,191 | A | * | 4/1991 | Corry | 248/48.2 |
| 5,271,192 | A | * | 12/1993 | Nothum, Sr. et al. | 52/12 |
| 5,570,860 | A | | 11/1996 | Schoenherr | 248/48.2 |
| D383,966 | S | * | 9/1997 | Zaccagni | D8/354 |
| 5,687,936 | A | | 11/1997 | Wilson | 248/48.2 |
| 6,209,826 | B1 | * | 4/2001 | Pratt, Jr. | 248/48.2 |
| 6,254,039 | B1 | * | 7/2001 | Zimmerman | 248/48.2 |

* cited by examiner

*Primary Examiner*—J. Allen Shriver
*Assistant Examiner*—Steven Marsh
(74) *Attorney, Agent, or Firm*—Sherrill Law Offices, PLLC

(57) ABSTRACT

An eaves trough support bracket which includes (a) a main beam having longitudinally spaced distal and proximal ends, laterally spaced first and second edges, and transversely spaced first and second surfaces, (b) a connection element extending in a first transverse direction from the distal end of the main beam, (c) a hook extending in the first transverse direction and second longitudinal direction from the proximal end of the main beam, and defining a concavity open in a second transverse direction, (d) a first leg extending in a second transverse direction from the first edge of the main beam with a proximal longitudinal end substantially transversely aligned with the proximal end of the main beam, and (e) a second leg extending in the second transverse direction from the second edge of the main beam with a proximal longitudinal end substantially transversely aligned with the proximal end of the main beam.

1 Claim, 2 Drawing Sheets

EAVES TROUGH SUPPORT BRACKET

FIELD OF THE INVENTION

The present invention relates to eaves trough support brackets.

BACKGROUND

Eaves troughs are commonly supported in position along the eaves of a building with eaves trough support brackets. A wide variety of eaves trough support brackets have been devised including those disclosed in U.S. Pat. Nos. 5,687,936 issued to Wilson, 5,570,860, issued to Schoenherr, 4,210,301, issued to Weiss, 3,737,127, issued to Maloney, Jr. et al., 3,426,987, issued to Leslie and 3,416,760, issued to Sauder 4,210,301, issued to Weiss.

U.S. Pat. No. 3,426,987 discloses a two-piece eaves trough bracket, which allows the longitudinal length of the bracket to be adjusted in order to accommodate eaves troughs of different widths. While generally effective for supporting an eaves trough, such brackets are relatively expensive due to the two-part construction, and provide limited vertical support to the distal edge of the eaves trough.

U.S. Pat. Nos. 3,416,760 and 4,210,301 disclose single piece eaves trough brackets which can be quickly and inexpensively manufactured by stamping a blank from sheet metal and bending the blank to the desired shape. While significantly less expensive than the two-piece bracket of U.S. Pat. No. 3,426,987, these brackets continue to provide limited vertical support to the distal edge of the eaves trough.

U.S. Pat. No. 3,737,127 discloses connection of a strap member to the longitudinal center of an eaves trough bracket and the roof in order to improve the vertical support provided by the bracket. While effective for improving the vertical support provided by the bracket, the strap significantly increases cost and complicates installation.

U.S. Pat. No. 5,570,860 discloses an eaves trough bracket having a main longitudinal support member, an arched transverse leg extending downward from directly below the proximal end of the main member and a diagonal brace extending from the distal end of the leg to the distal end of the main support member. While effective for improving the vertical support provided by the bracket, the bracket is relatively expensive as the configuration of the bracket prevents the bracket from being quickly and inexpensively stamped from sheet metal and bent to the desired shape.

Accordingly, a need exists for an inexpensive eaves trough support bracket, which is simple and easy to install, and capable of providing improved vertical support to the distal end of the eaves trough.

SUMMARY OF THE INVENTION

The invention is an inexpensive eaves trough support bracket, which is simple and easy to install, and capable of providing improved vertical support to the distal end of the eaves trough.

The eaves trough support bracket includes (a) a main beam having longitudinally spaced distal and proximal ends, laterally spaced first and second edges, and transversely spaced first and second surfaces, (b) a connection element extending in a first transverse direction from the distal end of the main beam, (c) a hook extending in the first transverse direction and a second longitudinal direction from the proximal end of the main beam, and defining a concavity open in a second transverse direction, (d) a first leg extending in a second transverse direction from the first edge of the main beam with a proximal longitudinal end substantially transversely aligned with the proximal end of the main beam, and (e) a second leg extending in the second transverse direction from the second edge of the main beam with a proximal longitudinal end substantially transversely aligned with the proximal end of the main beam.

The eaves trough support bracket is effective for supporting a length of eaves trough from an eave and can conveniently be provided as a "ready-to-install" combination of a length of eaves trough and a plurality of the eaves trough support brackets.

Eaves trough can be quickly and efficiently installed using the eaves trough support brackets by (i) obtaining a length of eaves trough having a bottom, a back wall, a front wall and a snap-lock channel formed along the distal edge of the front wall, (ii) obtaining a plurality of the eaves trough support brackets, (iii) engaging the connection element of the support bracket within the snap-lock channel formed in the eaves trough, (iv) sliding the distal edge of the rear wall of the eaves trough into the concavity defined by the hook to form a connected eaves trough assembly, (v) positioning the connected eaves trough assembly along an eave with the back wall of the eaves trough engaging the eave, and (vi) securing the connected eaves trough assembly to the eave by longitudinally driving a mechanical fastener through the hook of the bracket and the rear wall of the eaves trough, and into connective engagement with the eave

DETAILED DESCRIPTION OF THE INVENTION INCLUDING A BEST MODE

Nomenclature

Components

10 Bracket
20 Main Beam
21 Proximal End of Main Beam
22 Distal End of Main Beam
23 First Edge of Main Beam
24 Second Edge of Main Beam
25 First Surface of Main Beam
26 Second Surface of Main Beam
30 Connection Element
40 Strut
41 First End of Strut
42 Second End of Strut
50 Tab
51 First End of Tab
52 Second End of Tab
60 Hook
69 Concavity Defined by Hook
70 Shaft Portion of Hook
71 First End of Shaft Portion
72 Second End of Shaft Portion
79 Hole Through Shaft Portion of Hook
80 Hooking Portion of Hook

81 First End of Hooking Portion
82 Second End of Hooking Portion
90 Extension Portion of Hook
91 First End of Extension Portion
92 Second End of Extension Portion
99 Hole Through Extension Portion of Hook
110 First Leg
111 Proximal Longitudinal End of First Leg
112 Distal Longitudinal End of First Leg
120 Second Leg
121 Proximal Longitudinal End of Second Leg
122 Distal Longitudinal End of Second Leg
131 Rib Across First Bend Line
132 Rib Across Second Bend Line
133 Rib Across Third Bend Line
201 First Bend Line
202 Second Bend Line
203 Third Bend Line
204 Fourth Bend Line
204*d* Distal End of Fourth Bend Line
204*p* Proximal End of Fourth Bend Line
205 Fifth Bend Line
205*d* Distal End of Fourth Bend Line
205*p* Proximal End of Fourth Bend Line
300 Mechanical Fastener
400 Eaves Trough
409 Water Diversion Channel Defined by Eaves Trough
410 Bottom of Eaves Trough
420 Back Wall of Eaves Trough
422 Distal Edge of Back Wall of Eaves Trough
430 Front Wall of Eaves Trough
432 Distal Edge of Front Wall of Eaves Trough
440 Snap-Lock Channel
500 Eave Spatial Axes and Directions
x Longitudinal Axis
$x^1$ First Longitudinal Direction
$x^2$ Second Longitudinal Direction
y Latitudinal Axis
$y^1$ First Latitudinal Direction
$y^2$ Second Latitudinal Direction
z Transverse Axis
$z^1$ First Transverse Direction
$z^2$ Second Transverse Direction

DEFINITIONS

As utilized herein, including the claims, the term "mechanical fasteners," include nails, spikes, brads, staples, and screws.

As utilized herein, including the claims, the phrase "substantially perpendicular," means forming an angle $\alpha$ of between 60° and 120° (i.e., within 30° of perpendicular).

As utilized herein, including the claims, the phrase "substantially transversely aligned," means transversely spaced less than 0.4 inches.

Construction

Figure 1:
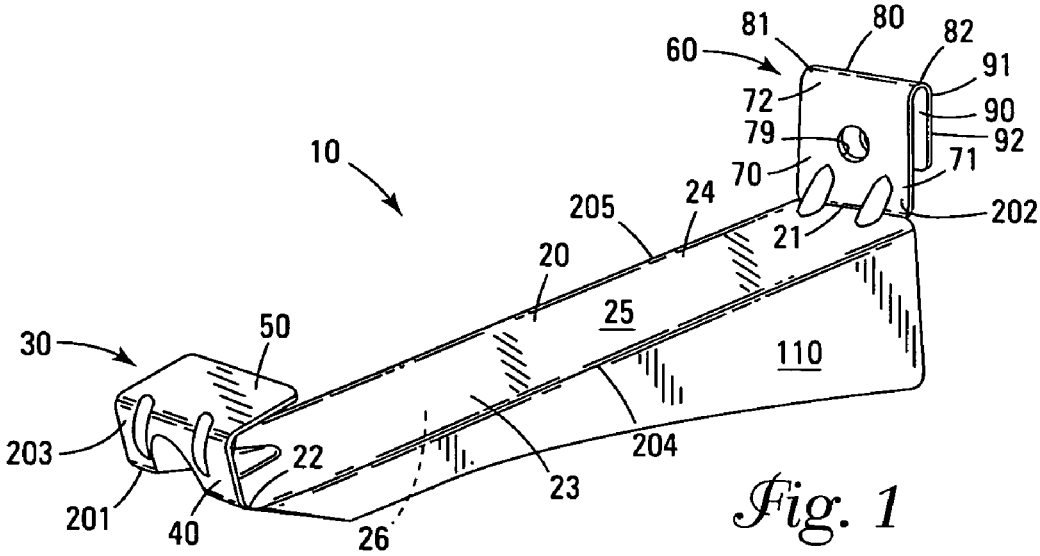
FIG. 1 is a front perspective view of a first embodiment of the invention.
Figure 2:
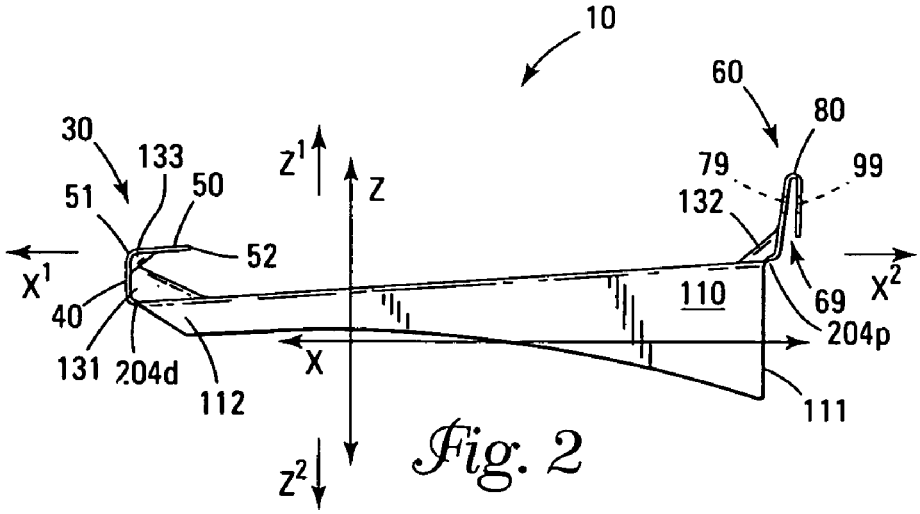
FIG. 2 is a right side view of the invention shown in FIG. 1.
Figure 3:
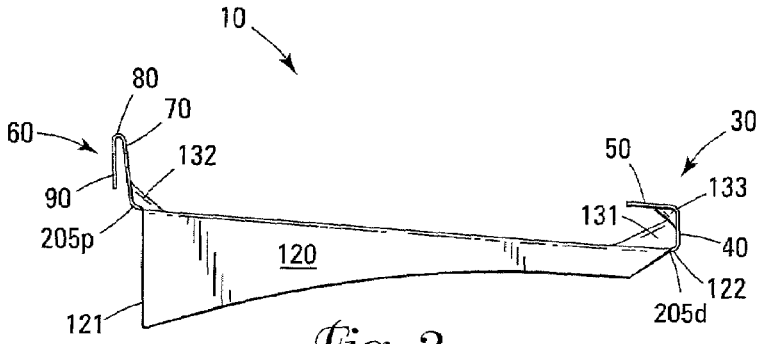
FIG. 3 is a left side view of the invention shown in FIG. 1.
Figure 4:
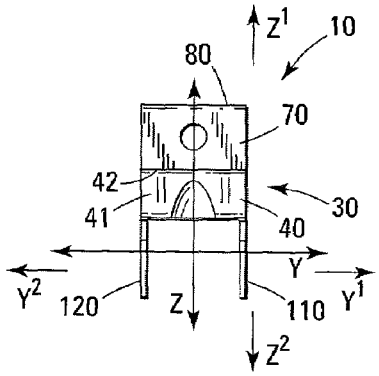
FIG. 4 is a front view of the invention shown in FIG. 1.
Figure 5:
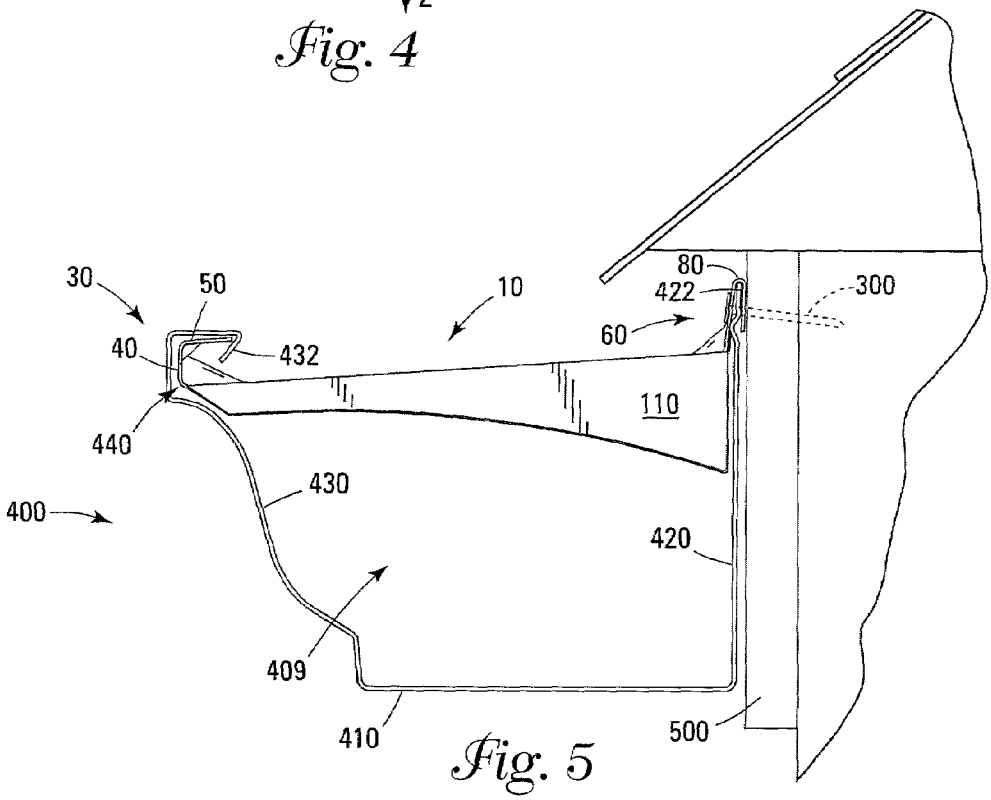
FIG. 5 is a side view of the invention shown in FIG. 1 positioned within a gutter.

Referring generally to FIGS. 1-5, a first aspect of the invention is an eaves trough support bracket 10, which includes a main beam 20, a connection element 30, a hook 60, a first leg 110 and a second leg 120.

The main beam 20 extends in a longitudinal direction x with a distal end 22 longitudinally spaced in a first longitudinal direction $x^1$ from a proximal end 21. The main beam 20 may be sized, shaped and configured as desired so long as the longitudinal length of the main beam 20 is matched with the longitudinal length of the eaves trough 400 to be installed with the bracket 10, is capable of securely supporting the eaves trough 400 cantilevered from an eave 500, and capable of withstanding normal wear and tear. Acceptable configurations of the main beam 20 include specifically but not exclusively, a rectangular plane, a lattice framework, a U-shaped beam, etc.

The main beam 20 preferably has (i) a longitudinal length of 5 inches or 6 inches in order to be compatible with commercially available eaves trough 400, (ii) a lateral width of about 0.5 to 2 inches, most preferably about 1 to 1.5 inches, in order to provide sufficient structural rigidity while limiting cost, and (iii) a transverse thickness of about 0.04 to 0.06 inches, preferably 0.04 to 0.05 inches in order to provide sufficient structural rigidity while limiting cost.

In a preferred embodiment, the main beam 20 defines (i) laterally spaced linear first 23 and second 24 edges, and (ii) a first major surface 25 facing a first transverse direction $z^1$ and a second major surface 26 facing a second transverse direction $z^2$.

The connection element 30 extends in both the first transverse direction $z^1$ and the second longitudinal direction $x^2$ from the distal end 22 of the main beam 20 for releasable engagement within the snap-lock channel 440 on the distal edge 432 of the front wall 430 of an eaves trough 400.

A preferred connection element 30 includes a strut 40 and a tab 50. The strut 40 extends substantially perpendicular in the first transverse direction $z^1$ from the distal end 22 of the main beam 20, with a first end 41 of the strut 40 connected to the distal end 22 of the main beam 20 and a second end 42 of the strut 40 transversely spaced from the distal end 22 of the main beam 20 in the first transverse direction $z^1$. The tab 50 extends substantially perpendicular in the second longitudinal direction $x^2$ from the second end 42 of the strut 40, with a first end 51 of the tab 50 connected to the second end 42 of the strut 40 and a second end 52 of the tab 50 longitudinally spaced from the second end 42 of the strut 40 in the second longitudinal direction $x^2$.

The connection element 30 may be sized, shaped and configured as desired so long as the connection element 30 extends in both the first transverse direction $z^1$ and the second longitudinal direction $x^2$ from the main beam 20, the connection element 30 is capable of securely supporting an eaves trough 400 cantilevered from an eave 500, and the connection element 30 is capable of withstanding normal wear and tear.

The connection element 30 preferably (i) extends a transverse distance of about 0.4 to 0.6 inches in the first transverse direction $z^1$ from the distal end 22 of the main beam 20 and a longitudinal distance of about 0.4 to 0.6 inches in the second longitudinal direction $x^2$ from the distal end 22 of the main beam 20 in order to be compatible with commercially available eaves trough 400, (ii) has a lateral width of about 0.5 to 2 inches, most preferably about 1 to 1.5 inches, in order to provide sufficient structural rigidity while limiting cost, and (iii) has a thickness of about 0.04 to 0.06 inches, preferably about 0.04 to 0.05 inches, in order to provide sufficient structural rigidity while limiting cost.

The hook 60 extends in the first transverse direction $z^1$ and the second longitudinal direction $x^2$ from the proximal end 21 of the main beam 20. The hook 60 defines a concavity 69 open in a second transverse direction $z^2$. The hook 60 is preferably laterally elongated so as to prevent lateral pivoting or rolling of the bracket 10 upon the distal edge 422 of the back wall 420 of the eaves trough 400 during installation or use.

In a preferred embodiment, the hook 60 includes a shaft portion 70, a hooking portion 80 and an extension portion 90.

The shaft portion 70 extends substantially perpendicular in the first transverse direction $z^1$ from the proximal end 21 of the main beam 20, with a first end 71 of the shaft portion 70 connected to the proximal end 21 of the main beam 20 and a second end 72 of the shaft portion 70 transversely spaced from the proximal end 21 of the main beam 20 in the first transverse direction $z^1$.

The hooking portion 80 extends in the second longitudinal direction $x^2$ from the second end 72 of the shaft portion 70, with a first end 81 of the hooking portion 80 connected to the second end 72 of the shaft portion 70 and a second end 82 of the hooking portion 80 longitudinally spaced from the second end 72 of the shaft portion 70 in the second longitudinal direction $x^2$. The second end 82 of the hooking portion 80 is also longitudinally spaced from the proximal end 21 of the main beam 20 in the second longitudinal direction $x^2$. The hooking portion 80 preferably forms an approximately 180° arch with the apex (unnumbered) of the arch extending in the first transverse direction $z^1$.

The extension portion 90 of the hook 60 extends in the second transverse direction $z^2$ from the second end 82 of the hooking portion 80, with a first end 91 of the extension portion 90 connected to the second end 82 of the hooking portion 80 and a second end 92 of the extension portion 90 transversely spaced from the second end 82 of the hooking portion 80 in the second transverse direction $z^2$. The extension portion 90 is preferably positioned parallel to the shaft portion 70.

The hook 60 preferably (i) extends a transverse distance of about 0.8 to 1 inch, preferably about 0.85 to 0.9 inches, in the first transverse direction $z^1$ from the distal end 22 of the main beam 20, (ii) has a lateral width of about 0.5 to 2 inches, most preferably about 1 to 1.5 inches, in order to provide sufficient structural rigidity and preventing lateral pivoting or rolling of the bracket 10 upon the distal edge 422 of the back wall 420 of the eaves trough 400 during installation or use while limiting cost, and (iii) has a thickness of about 0.04 to 0.06 inches, preferably about 0.04 to 0.05 inches, in order to provide sufficient structural rigidity while limiting cost.

The concavity 69 defined by the hook 60 preferably has (i) has a longitudinal depth sufficient to allow fitted engagement of the distal edge 422 of the back wall 420 of the eaves trough 400 into the concavity 69, and (ii) a transverse height of about 0.8 to 1 inch, preferably about 0.8 to 0.9 inches, so that the mechanical fastener 300 used to attach the bracket 10 to an eave 500 will catch the extension portion 90 and thereby increase the structural integrity of the attachment.

A first 110 and a second leg 120 extend in the second transverse direction $z^2$ from the first edge 23 and the second edge 24 of the main beam 20 respectively.

The first and second legs 110 and 120 each have a proximal longitudinal end 111 and 121, respectively, which is substantially transversely aligned with the proximal end 21 of the main beam 20. Such transverse alignment allows the proximal longitudinal ends 111 and 121 of the first and second legs 110 and 120, respectively, to rest upon the back wall 420 of the eaves trough 400 and the eave 500 when installed, and thereby increase the structural integrity of the installed eaves trough 400 relative to a force applied in the second transverse direction $z^2$ anywhere along the longitudinal length of the main beam 20, including such a force applied to the distal end 22 of the main beam 20 of the bracket 10 resulting from a downward force applied to the bottom 410 and/or front wall 430 of the eaves trough 400.

The first and second legs 110 and 120 preferably extend in the longitudinal direction at least one-half the longitudinal length, preferably at least three-fourths the longitudinal length, of the main beam 20 along the first and second edges 23 and 24, respectively. Such longitudinal extension of the legs 110 and 120 increases the structural integrity of the main beam 20 relative to a force applied in a transverse direction $z^2$ anywhere along the longitudinal length of the main beam 20.

The first and second legs 110 and 120 may be independently sized, shaped and configured as desired so long as the legs 110 and 120 extend in the second transverse direction $z^2$ from the main beam 20 with proximal longitudinal ends 111 and 121, respectively, which are substantially transversely aligned with the proximal end 21 of the main beam 20.

The legs 110 and 120 are preferably mirror images of one another with a generally triangular shape when viewed in the lateral direction y. The legs 110 and 120 preferably (i) extend a transverse distance of about 0.2 to 1.5 inches, preferably 0.5 to 1.5 inches, in the second transverse direction $z^2$ from the proximal end 21 of the main beam 20, (ii) extend longitudinally along the edges 23 and 24 of the main beam 20 from the proximal end 21 of the main beam 20 to within about 0.2 inches of the distal end 22 of the main beam 20, and (iii) have a thickness of about 0.04 to 0.06 inches, preferably about 0.04 to 0.05 inches, in order to provide sufficient structural rigidity while limiting cost.

Ribs 131, 132, and 133 are preferably provided (e.g., stamped) across and substantially perpendicular to the first 201, second 202, and third 203 bend lines, respectively, in order to improve the longitudinal structural strength of the bracket 10 along the bend lines 201, 202, and 203. The rib 131 across the first bend line 201 preferably extends a distance in the second longitudinal direction $x^2$ from the distal end 22 of the main beam 20 sufficient to cause the rib 131 to extends beyond the distal longitudinal ends 204*d* and 205*d* of the fourth and fifth bend lines 204 and 205, respectively, and thereby provide improved structural integrity of the main beam 20 relative to a force applied in a transverse direction $z^2$ along the entire longitudinal length of the main beam 20.

The bracket 10 preferably includes longitudinally aligned holes 79 and 99 through the shaft portion 70 and the extension portion 90 of the hook 60, respectively, for accommodating passage of the shaft (unnumbered) of a mechanical fastener 300 throughout the holes 79 and 99 during installation.

The holes 79 and 99 are preferably transversely positioned on the hook 60 that the holes 79 and 99 will be vertically positioned above the distal edge 432 of the front wall 430 of the eaves trough 400 after installation of the eaves trough assembly so that any water (not shown) retained within the water diversion channel 409 defined by the eaves trough 400 will spill over the distal edge 432 of the front wall 430 of the eaves trough 400 before contacting and entering either of the holes 79 and 99 in the hook 60.

Manufacture

The bracket 10 is preferably integrally formed from a single mass of material as a single unitary article. Materials from which the bracket 10 may be constructed include any material having the necessary structural integrity and weatherability including specifically, but not exclusively: metals, such as aluminum and steel; and plastics, such as poly vinyl chloride and polyurethane. Selection of a suitable material is well within the competency of those having ordinary skill in the art.

The bracket 10 is preferably manufactured from a metal, such as aluminum, by (i) stamping bracket blanks (not shown) from sheet stock (not shown), (ii) punching holes 79 and 99 through the bracket blanks at the appropriate locations, (iii) bending each bracket blank along bends lines 201, 202, 203, 204, and 205 to form a bracket 10, and (iv) stamping ribs 131, 132, and 133 into the bracket 10. The entire manufacturing process can be completed on a continuous basis utilizing commercially available converting equipment.

Installation

Eaves trough 400 can be quickly and easily installed along the eaves 500 of a building (unnumbered) utilizing the brackets 10. After obtaining a length of eaves trough 400 and cutting the eaves trough 400 to the proper lateral length, brackets 10 are fitted onto the eaves trough 400 at a lateral spacing of about 1 to 3 feet along the lateral length of the eaves trough 400 by (i) engaging the connection element 30 of each support bracket 10 within the snap-lock channel 440 formed in the eaves trough 400, and (ii) sliding the distal edge 422 of the back wall 420 of the eaves trough 400 into the concavity 69 defined by the hook 60.

The eaves trough assembly is then lifted into position along an eave 500 with the back wall 420 of the eaves trough 400 engaging the eave 500, and the eaves trough 400 connectively attached to the eave 500 by longitudinally driving a mechanical fastener 300, preferably a screw, through the hook 60 and that portion of the rear wall 420 of the eaves trough 400 engaged within the concavity 69 defined by the hook 60.

When holes 79 and 99 are provided in the hook 60 of each bracket 10, proper positioning and alignment the mechanical fasteners 300 is ensured and the fastener 300 can be driven through the holes 79 and 99 with minimal resistance.

I claim:

1. An eaves trough support bracket, comprising:

(a) a main beam having longitudinally spaced distal and proximal ends, laterally spaced first and second edges, and transversely spaced first and second surfaces;

(b) a connection element extending in a first transverse direction from the distal end of the main beam;

(c) a hook extending in the first transverse direction and a second longitudinal direction from the proximal end of the main beam, and defining a concavity open in a second transverse direction;

(d) a first leg (i) extending in a second transverse direction from the first edge of the main beam with a proximal longitudinal end substantially transversely aligned with the proximal end of the main beam, and (ii) having a transverse height that tapers in the second transverse direction with a transverse height at the longitudinal center of the main beam of less than one half the transverse height at the proximal longitudinal end of the first leg; and (e) a second leg (i) extending in the second transverse direction from the second edge of the main beam with a proximal longitudinal end substantially transversely aligned with the proximal end of the main beam, and (ii) having a transverse height that tapers in the second transverse direction with a transverse height at the longitudinal center of the main beam of less than one half the transverse height at the proximal longitudinal end of the second leg.

* * * * *